US005193577A

United States Patent [19]

de Koning

[11] Patent Number: 5,193,577

[45] Date of Patent: Mar. 16, 1993

[54] SLUDGE PUMP VALVE

[75] Inventor: Cornelis J. de Koning, Ed Velden, Netherlands

[73] Assignee: Holthuis B.V, Venlo, Netherlands

[21] Appl. No.: 896,470

[22] Filed: Jun. 9, 1992

Related U.S. Application Data

[63] Continuation-in-part of Ser. No. 743,983, Aug. 12, 1991, abandoned, which is a continuation-in-part of Ser. No. 602,516, Oct. 24, 1990, abandoned.

[30] Foreign Application Priority Data

Jun. 25, 1990 [NL] Netherlands ..... 9001445

[51] Int. Cl.[5] ..... F16K 15/06

[52] U.S. Cl. ..... 137/516.29; 251/332

[58] Field of Search ..... 137/516.25, 516.27, 137/516.29, 902; 251/332

[56] References Cited

U.S. PATENT DOCUMENTS

| | | | |
|---|---|---|---|
| 2,002,672 | 5/1935 | Melott | 137/516.29 |
| 2,011,547 | 8/1935 | Campbell | 137/516.29 |
| 2,163,472 | 6/1939 | Shimer | 137/516.29 |
| 2,900,999 | 8/1959 | Courtot | 251/334 X |
| 3,191,617 | 6/1965 | Maddox | 251/332 X |
| 3,332,437 | 7/1967 | Hallen | 137/516.29 |
| 3,409,039 | 11/1968 | Griffin | 137/516.29 |
| 3,540,472 | 11/1970 | Brady et al. | 137/516.29 |
| 4,860,995 | 8/1989 | Rogers | 137/516.29 X |
| 4,922,957 | 5/1990 | Johnson | 137/902 X |
| 4,951,707 | 8/1990 | Johnson | 137/516.29 |

*Primary Examiner*—John Rivell
*Attorney, Agent, or Firm*—Morrison Law Firm

[57] ABSTRACT

A sludge pump valve for use in pumping systems which pump aggressive, abrasive, and corrosive liquids containing granular material, pumped over long distances and at high pressures, employs a pair of elastic sealing elements provided, respectively, with spherically configured convex and concave surfaces that mate along a spherical contact surface during valve closing to effect leak-free seal of the valve, the arrangement being such that valve is made more maintainence free and has a longer service life.

6 Claims, 2 Drawing Sheets

SLUDGE PUMP VALVE

This application is a continuation-in-part of application Ser. No. 07/743,983 filed Aug. 12, 1991, now abandoned, which in turn is a continuation-in-part of application Ser. No. 07/602,516, filed Oct. 24, 1990, now abandoned.

BACKGROUND OF THE INVENTION

The present invention relates to a valve for use in a sludge pump system. The valve is used in pumping systems, generally in combination with a displacement pump.

The pumping systems are used to transfer aggressive, abrasive and corrosive liquids containing granular material such as sand, coal, ore, found, for example, in mining waste. These liquids are frequently pumped over long distances, often at high temperatures, and under high pressures. Such conditions place extremely high demands on the durability of the pumping systems components including the valve.

Dutch Patent Application No. 8600545 describes a valve for use in a pumping system with a metal to metal contact surface, partially with a metal to elastic material contact surface. The metal to elastic material contact surface allows sludge material, which is present between the contact surfaces when the valve closes, and, as a result, is under extra high pressure, to escape via grooves provided in the metal contact without causing damage to the valve. The use of elastic sealing rings under the conditions described above, creates new problems, as are mentioned in the Dutch Patent Application. In use, the elastic material wears very quickly, thereby failing in its intended function. The result is that the elastic sealing rings must constantly be replaced. This results in shut down of the system, with the attendant consequences, such as cost, etc. Attempts have been made to avoid replacing the sealing rings by using symmetrical rings. Thus, the rings which were worn on one side could be reversed and reused. However, even this approach has not been fully successful and there has been a considerable decline in the use of elastic sealing rings.

OBJECTS AND SUMMARY OF THE INVENTION

Accordingly, it is an object of the invention to provide a valve which overcomes the drawbacks of the prior art.

It is a further object of the invention to provide a valve for use in pumping systems which pump aggressive, abrasive, and corrosive liquids containing granular material, pumped over long distances and/or at high temperatures and pressures which has a longer life and a longer maintenance free period than the valves of the prior art.

It is a still further object of the invention to provide a valve which when used under the conditions described above, possesses a longer lifetime than the valves of the prior art which generally must be replaced after one month of use.

Briefly stated, the present invention provides a valve for use in pumping systems which pump agressive, abrasive and corrosive liquids containing grannular material, the pumping being over long distances and at high pressures. The valve employs a pair of elastic sealing elements which, respectively, have spherically configured convex and concave surfaces that mate along a sperical contact surface when the valve is closed to effect leak-free seal of the valve, this arrangement giving a more maintainence free valve and one having a longer service life.

According to an embodiment of the invention, there is provided, a valve suitable for use in a sludge system comprising a valve body, guide means for guiding axial movement of the valve body, an elastic sealing ring and a metal supporting element on the valve body. The supporting element and the elastic sealing ring each having a contact surface. A valve seat is provided in the in the valve body, and it includes a metal part and an elastic part and these each have a contact surface. The contact surface on the metal supporting element and that on the metal part, and the contact surface on the elastic sealing ring and that on the elastic part, respectively, are moved into contact with each other in a closing movement of the valve body against the valve seat. The contact surface on the elastic sealing ring is concave, and that on the elastic part is concave, with the elastic sealing ring being carried on the valve body and the elastic part on the valve seat such that during valve closing movement, the elastic sealing ring and the elastic part contact each other only along the respective contact surfaces of each. The radius of curvature of the elastic part concave surface is smaller than the radius of curvature of the elastic sealing ring convex surface whereby a first point of contact between the contct surfaces of the elastic sealing ring and elastic part occurs at a radially outermost location of the contact surfaces. The metal supporting element and the metal part, respectively, are carried on the valve body and the valve seat, respectively, such that during valve closure movement the two contact each other only and along the contact surfaces of each.

The above and other objects and advantages of the present invention will become apparent from the following description read in conjunction with the accompanying drawings, in which like reference numerals designate the same element.

DETAILED DESCRIPTION OF THE PREFERRED EMBODIMENTS

Figure 1:
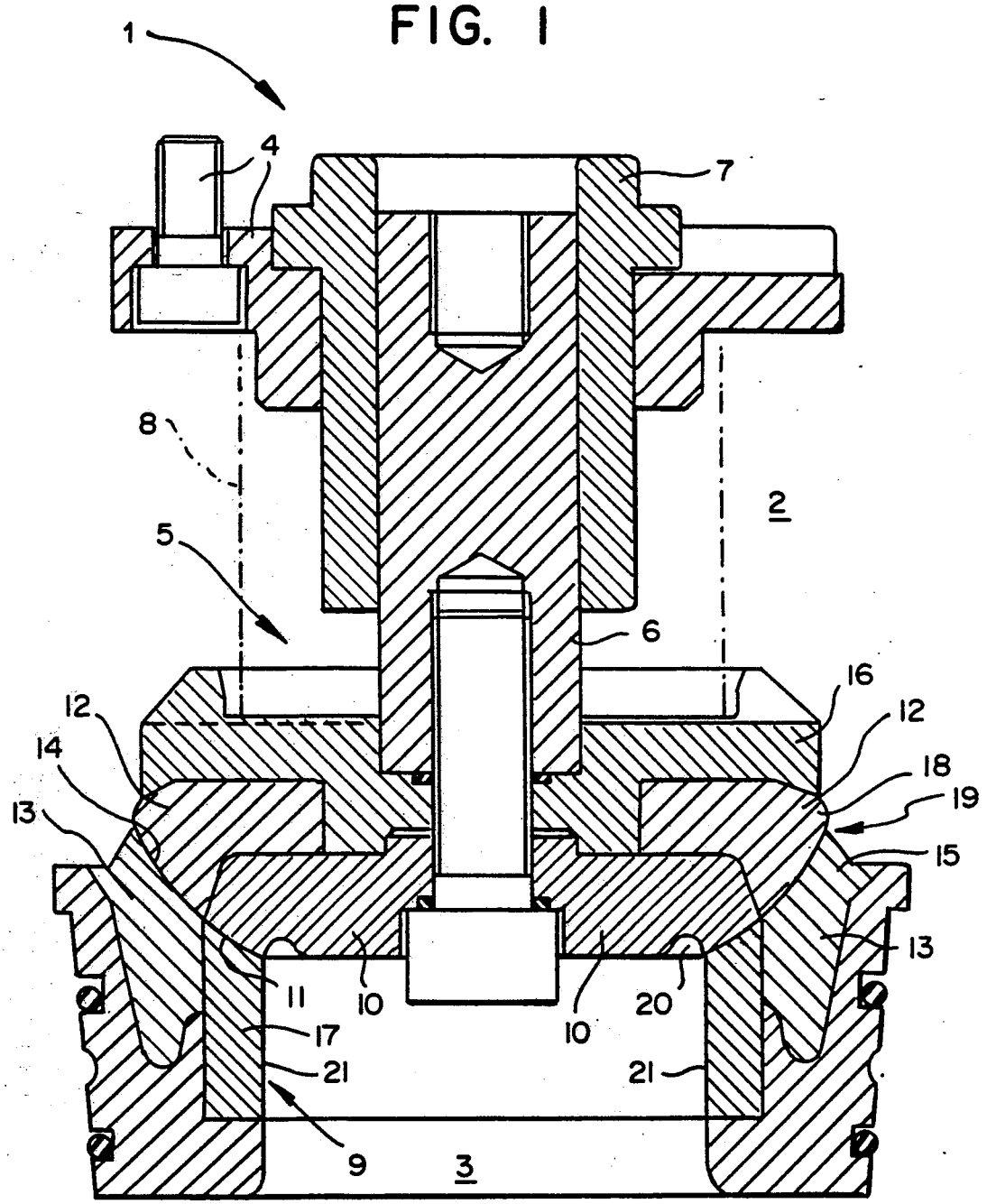
FIG. 1 is a cross sectional view of one embodiment of valve made according to the invention.

Referring to the valve embodiment 1 depicted in FIG. 1, it may be used, for example, as a suction or delivery valve in pumps such as displacement pumps for pumping mixtures containing liquid and solid materials.

Valve 1 contains a high pressure side 2 and a low pressure side 3. When the valve is closed, the pressure in side 3 is lower than in side 2. Valve 1 has a valve casing (not shown), and a valve body 5 wich can move in such valve casing. Attached to valve body 5 is valve stem 6 which will be mounted in the valve casing in such a manner as to be moveable in sleeve 7. Sleeve 7 will be attached to the valve casing with securing means shown generally at 4.

If valve 1 is of the self-working type and is moved by the pressure of the medium at sides 2 and 3 of the valve, then a spring depicted in phantom at 8, is placed between valve body 5 and sleeve 7 in the valve casing. If the valve is not of the self-working type, then the movement of valve body 5 will be effected by way of means (not shown), which are operated outside the valve.

Located in valve 1 is valve seat 9, which has a generally spherical contact surface. Valve body 5 has a corresponding spherical contact surface. Valve body 5 has a metal supporting element 10 which defines a spherically contoured metal-to-metal contact surface 11.

An elastic ring 12 is mounted on valve body 5. Elastic ring 13 is mounted on valve seat 9. Both rings 12 and 13 have corresponding contact surfaces which form the elastic contact surface 14.

The internal and external diameters, respectively, of rings 12 and 13 are such that when valve 1 closes, rings 12 and 13, first make contact at a point shown at 19. This point 19 is the radially outermost point of common contact between the elastic contact surface between the rings 12 and 13. When the valve body 5 moves downwardly fully, the metal-on-metal contact between valve seat 9 and the metal element 10 is effected. In this process, the elastic ring 13 in the valve seat gives away outwardly and presents a bulging section as 18.

It is desirable that the distinct contact surfaces 11 and 14, which are preferably bordering each other have a curved configuration whereby one of the contact surfaces may be concave and the other convex, as shown in FIG. 1, ring 12 in that embodiment being convexly curved and ring 13 concavely curved. The contact surface curvature conveniently is, as noted above, of spherical configuration. Other curvature forms such as ellipitical also can be used. The curvature though will be such that the radius of curvature of the concave surface of ring 13 is smaller than that of the convex ring 12, this being such as to insure first contact between the valve body and valve seat during downward body movement occurs at point 19.

Sealing ring 12 is constructed in such manner that its largest diameter is larger than the diameter of the elastic contact surface 14. Thus, under conditions of either surface wearing or deterioration particularly of the elastic particular at an uppermost lip section 15 of the ring 13, a good seal at surface 14 still is obtained.

The largest diameter defined by contact surface 14 is about equal to the largest diameter of a ring holder plate 16 which encapsulates or mounts ring 12, such element being attached as a part of valve body 5. In the event of wear of a bulging section 18 of ring 12, the diameter will be restored to that of the encapsulating element 16, and no stair-like wear will occur.

An annular cutout 20 is made along the circumference of the underside of element 10 in such a way that, if the receiving surface of element 10 becomes worn, the contact surface 11 will not show a stair-like wear pattern, whereby element 10 would partially drop between the walls 21 of element 7 and closely adjacent these walls which define at the top parts thereof, the metal contact surface 11. Such drop if closely adjacent the walls, undesirably would cause wear in round shape at the upper edges of the walls.

Figure 2A:
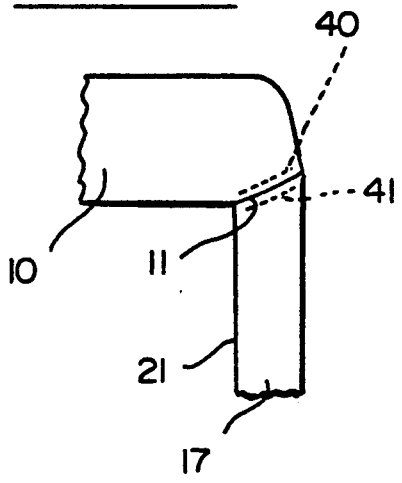
FIG. 2a PRIOR ART
FIGS. 2*a* and 2*b* depict wear that can occur on the metal-to-metal contact surfaces of a valve of the prior art.
Figure 2B:
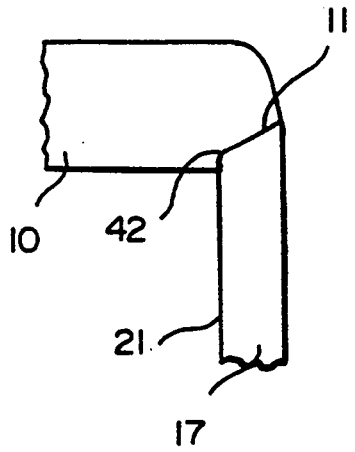
FIG. 2b PRIOR ART

FIGS. 2*a* and 2*b* show the undesirable wear effect which can result where no undercut exists. FIG. 2*a* shows how metal-to-metal contact surface 11 exists in a valve where no or only little service use has taken place. With use though, the regions 40, 41, respectively, in the elements 10, 17 wear due to repeated contact taking place during closings. This wear can become so severe that as seen in FIG. 2*b*, rounding as at 42 at the top or contact surface of element 17 develops. Further, the step or stair-like effect of the lower face of element 10 entering between the walls 21 of the element 17 is produced. The sum effect is that the geometry of the contact surface between the elements 10 and 17 is completely changed leading to failure of seal and resulting leakage at that location.

Figure 3A:
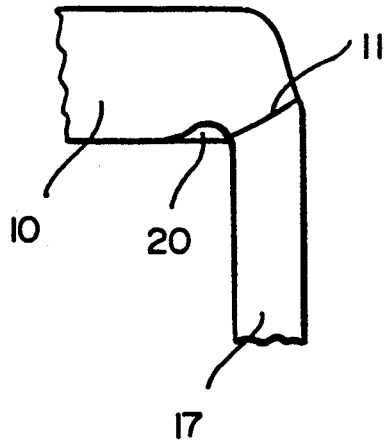
FIGS. 3*a* and 3*b* show how the contact surface wear of the prior art is avoided by providing an undercut in the valve body of the FIG. 1 valve.
Figure 3B:
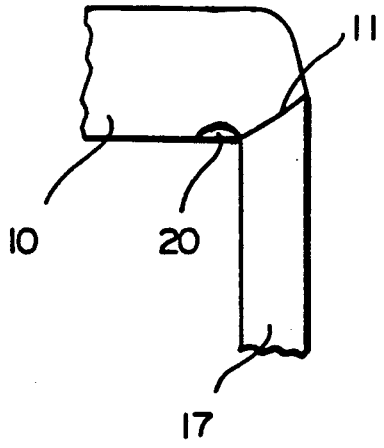

FIGS. 3*a* and 3*b* shown how this is overcome. In FIG. 3*a*, the full undercut 20 is shown. With use, wear takes place only at the contacting surfaces of elements 10, 17. Due to the undercut, no structure part of the element 10 can serve to form a corner around the lower or inner point of the contact surface 11 of element 17. Hence, there can be no rounding wear produced at that location.

In the prior art where a metal contact to elastic material contact surface is employed, it has been found that the high degree of wear of elastic material in the valve of the prior art can be attributed to particles in the sludge, which due to their presence on the metal contact surface during the closing of the valve, are pushed or forced into the contact surface side presented by the elastic material only (they cannot in any appreciable manner enter the metal surface side) resulting in heavy damage in a short period of time to the plastic. In contrast, in the present invention, the aforesaid particles are elastically embedded or held in or between the two elastic contact surfaces presented by these rings during valve closing, this happening in such manner that there is just minor deformation of the rings elastic surfaces, with the result that upon opening, the solids are freed from the surfaces without having caused damage to the ring surfaces.

In using common elastic materials, the life of the elastic materials is prolonged, so that the times between maintenance are increased, which reduces costs. In known sludge pump systems, it is usual to subject the solid particles in the media to be transported to a pre transport reduction process to sufficiently reduce the size of the particles. This reduction process can be reduced by using the valve as claimed herein, without risking damage to the valve by sludge particles having a large average size due to the two sided elastic embedding of the sludge particles trapped between the elastic sealing rings of the valve during closing.

The presence of the metal supporting elements in the valve of this invention support the elastic material of the sealing rings of the valve body and the valve seat. The valve so constructed is suitable of sustaining working pressures in the order of from 30 to 300 bars.

In a preferred embodiment of this invention, the cross section of the sealing rings and the elements is chosen in such a way that when the valve body is moving in the direction of the valve seat, the sealing rings are the first to come in contact with each other, first at the top and progressively downwards. The advantages of this embodiment is that besides the two sided embedding of the sludge particles in the elastic contact surface during valve closure and the coming together of the contact rings, just before closure of the metal supporting elements, the metal contact surface concerned is cleaned by the sludge as it escapes from between the surfaces.

Also, in the valve according to this invention, the point of the elastic contact surface which lies opposite to that point where the contact surfaces touch each other has sufficient freedom to execute a radial motion with respect to the motional axis of the valve body. The freedom to execute this motion forms a basis for making the elastic contact surface curvilinear. It is preferred to have a curved contact surface between the elastic sealing rings, particularly a contact surface with a spherical form. Therefore, if the descent of the valve body is not perfectly straight arising, for example, from play in the guiding means, it is less likely to result in an incorrect seating, so that wear will not significantly increase.

As far as the wear process of the respective contact surfaces is concerned, the geometry of the contact surfaces plays an important role. Thus, the following criteria should be met:

a) the maximum external diameter of the elastic sealing ring of the valve body is a maximum of 1.05 times larger than the maximum diameter of the contact surface concerned;

b) the maximum external diameter of the elastic sealing ring of the valve body is a maximum of 1.05 times larger than the maximum diameter of an encasing element or ring holder plate to which the sealing ring is mounted at the high pressure side of the valve stem; and c) an undercut should be made in the metal supporting element at the low pressure side near the metal contact surface.

These criteria ensure that, as the wear process progresses, the geometry of the valve of this invention remains the same, despite the fact that in the long term, the valve body comes to rest in a progressively lower position on the valve seat.

A further advantage of the incision is that, if the supporting element becomes worn by the valve body, the valve body will not fall between the supporting element and the valve seat. Accordingly, stair-like wearing effects on the metal contact surface are avoided.

Having described preferred embodiments of the invention with reference to the accompanying drawings, it is to be understood that the invention is not limited to the precise embodiments and that various changes and modifications may be affected therein by one skilled in the art without departing from the scope or spirit of the invention which is limited only by the appended claims.

What is claimed is:

1. A valve suitable for use in a sludge system comprising, a valve body, guide means for guiding axial movement of the valve body, an elastic sealing ring and a metal supporting element on the valve body, the supporting element and the elastic sealing ring each having a contact surface, and a valve seat in the valve body, the valve seat including a metal part and an elastic part, the metal part and the elastic part each having a contact surface, the contact surface on the metal supporting element and that on the metal part, and the contact surface on the elastic sealing ring and that on the elastic part, respectively, being moved into contact with each other in a closing movement of the valve body against the valve seat, the contact surface on the elastic sealing ring being convex and the contact surface on the elastic part being concave, the elastic sealing ring being carried on the valve body and the elastic part being carried on the valve seat such that during valve closing movement, the elastic sealing ring and the elastic part contact each other only along the respective contact surfaces of each, the radius of curvature of the elastic part concave surface being smaller than the radius of curvature of the elastic sealing ring convex surface whereby a first point of contact between the contact surfaces of the elastic sealing ring and the elastic part occurs at a radially outermost location of the said contact surfaces, the metal supporting element and the metal part, respectively, being carried on the valve body and the valve seat, respectively such that during valve closure movement the two contact each other only and along the contact surfaces of each.

2. A valve according to claim 1, wherein the elastic sealing ring and elastic part on the one hand, and the metal supporting element and the metal part on the other hand, are in mutual contact with each other along spherical surfaces.

3. A valve according to claim 1, wherein the elastic sealing ring is configured and sized such as to bulge radially of valve movement direction adjacent the location of first point of contact of the elastic sealing ring and elastic part.

4. A valve according to claim 1, wherein a maximum external diameter of the elastic sealing ring is about 1.05 times larger than a maximum diameter of the contact surfaces of the elastic sealing ring and elastic part.

5. A valve according to claim 1, wherein a maximum external diameter of the elastic sealing ring is about 1.05 times larger than a maximum diameter of an elastic ring holder plate which mounts the elastic sealing ring.

6. A valve according to claim 1, wherein an annular undercut is provided in a lower face of the metal supporting element adjacent an inner end of the surfaces at which the metal supporting element and metal part contact each other during valve closing whereby any wear of the contact surfaces will not be accompanied by any drop of the metal supporting element at locations closely adjacent walls defining the metal part.

* * * * *